US006494124B1

(12) United States Patent
Castillo

(10) Patent No.: US 6,494,124 B1
(45) Date of Patent: Dec. 17, 2002

(54) SELF-CONTAINED HYDRAULIC SYSTEM

(76) Inventor: Carlos Castillo, 650 NW. 49 Ave., Coconut Creek, FL (US) 33063

( * ) Notice: Subject to any disclaimer, the term of this patent is extended or adjusted under 35 U.S.C. 154(b) by 0 days.

(21) Appl. No.: 09/905,827

(22) Filed: Jul. 13, 2001

(51) Int. Cl.[7] ..... F15B 21/00
(52) U.S. Cl. ..... 91/4 R; 91/5
(58) Field of Search ..... 91/4 R, 5; 60/414, 60/417, 415

(56) References Cited

U.S. PATENT DOCUMENTS 3,147,946 A * 9/1964 Hale ..... 91/4 R
3,756,654 A * 9/1973 Bauer ..... 297/301.1
5,333,533 A * 8/1994 Hosseini ..... 60/469

* cited by examiner

*Primary Examiner*—Edward K. Look
*Assistant Examiner*—Thomas E. Lazo
(74) *Attorney, Agent, or Firm*—J. Sanchelima; A. Bordas

(57) ABSTRACT

A self-contained hydraulic system used with lifting mechanisms to aid in the lifting of their arms before undertaking lifting operations. The system includes a hydraulic reservoir for a liquid and a gas that share the space under pressurized conditions. A hydraulic control assembly regulates flow through the outlet of the reservoir to use from a hydraulic assembly used to lift the arm of a lifting mechanism. The hydraulic control assembly includes two normally closed, electrically activated valves, connected in series. One of them being unidirectional and including a bypass valve to graduate the flow and thus the speed at which the lifting arm moves. Optionally, a flow fuse valve can be used to limit the maximum flow through the system.

6 Claims, 2 Drawing Sheets

$$\frac{P_1V_1}{T_1} = \frac{P_2V_2}{T_2}$$

SELF-CONTAINED HYDRAULIC SYSTEM

II. BACKGROUND OF THE INVENTION

1. Field of the Invention

The present invention relates to a self power hydraulic system, and more particularly, to a self-contained hydraulic system for crane lifts and/or davits that utilize a reservoir for hydraulic fluid and gas, under pressure.

2. Description of the Related Art

Many designs for hydraulic systems have been designed in the past. None of them, however, include a system for storing energy that can be used in conjunction with a lifting apparatus without requiring pumps to generate of maintain the pressure required for lifting loads.

Applicant believes that the closest reference corresponds to U.S. Pat. No. 4,052,852 issued to Cullen P. Hart in 1977 for a constant pressure sealed fluid storage tank for hydraulic systems and U.S. Pat. No. 2,492,014 issued to T. R. Spalding et al. in 1949 for a combined reservoir and accumulator in a hydraulic pump and motor transmission system. Both patented inventions include a storage assembly for fluids. However, these differ from the present invention because they both require pumps to maintain the pressure.

Other patents describing the closest subject matter provide for a number or more or less complicated features that fail to solve the problem in an efficient and economical way. None of these patents suggest the novel features of the present invention.

III. SUMMARY OF THE INVENTION

It is one of the main objects of the present invention to provide a system for storing energy that can be used in conjunction with a lifting apparatus to aid a user in lifting loads.

It is another object of this invention to provide a self-contained system that can be used for extended periods of time without requiring replenishment or other service.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
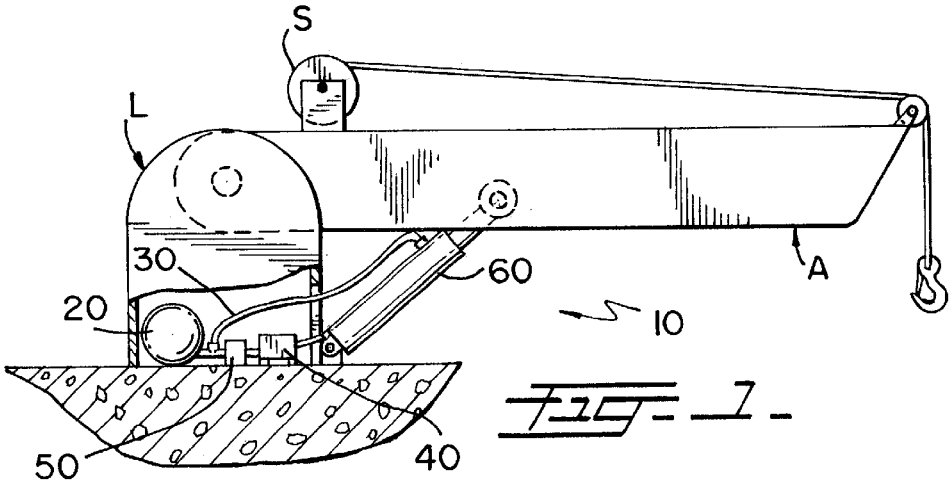

With the above and other related objects in view, the invention consists in the details of construction and combination of parts as will be more fully understood from the following description, when read in conjunction with the accompanying drawings in which:

FIG. 1 represents a front elevational view of a lift assembly hydraulic system, incorporating the present invention, when the arm is in horizontal and lower most position.

Figure 1A:
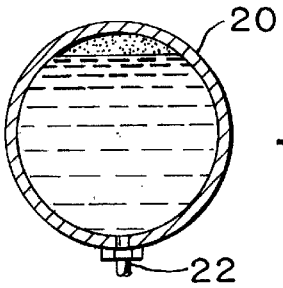

FIG. 1*a* illustrates the reservoir for the hydraulic fluid of the present invention when the lifting assembly is in the lower most position shown in FIG. 1.

Figure 2:
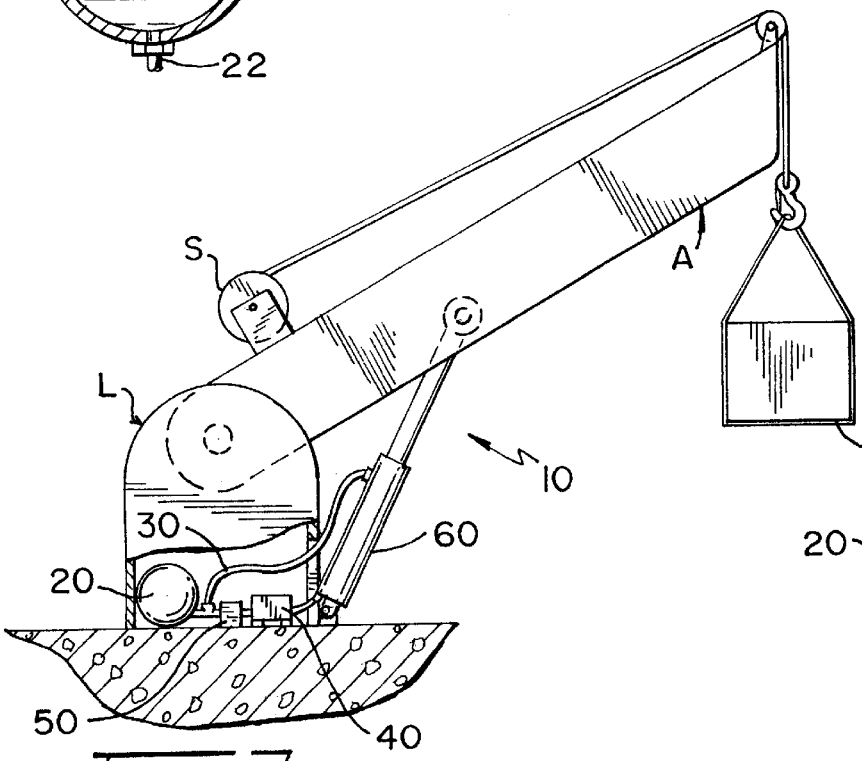

FIG. 2 shows a front elevational view of the lift assembly, when the arm is in an elevated position.

Figure 2A:
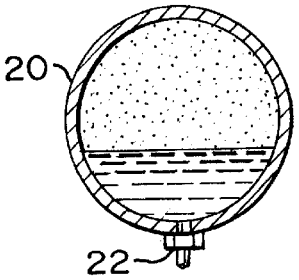

FIG. 2*a* illustrates the reservoir for the hydraulic fluid of the present invention when the lifting assembly is in the elevated position shown in FIG. 2.

Figure 3B:
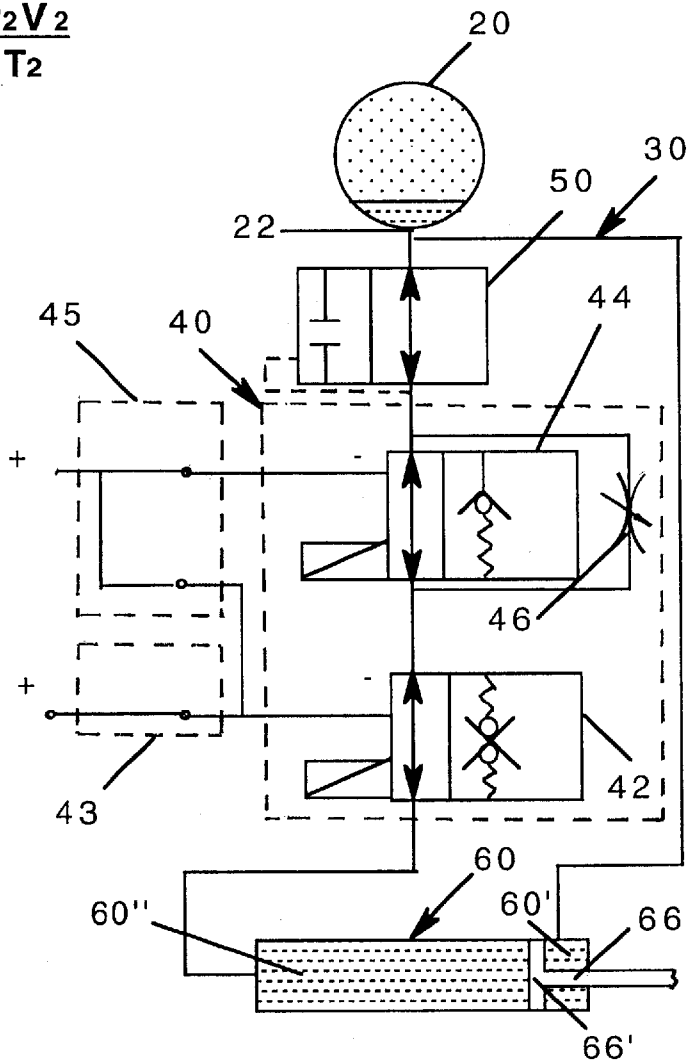
Figure 3A:
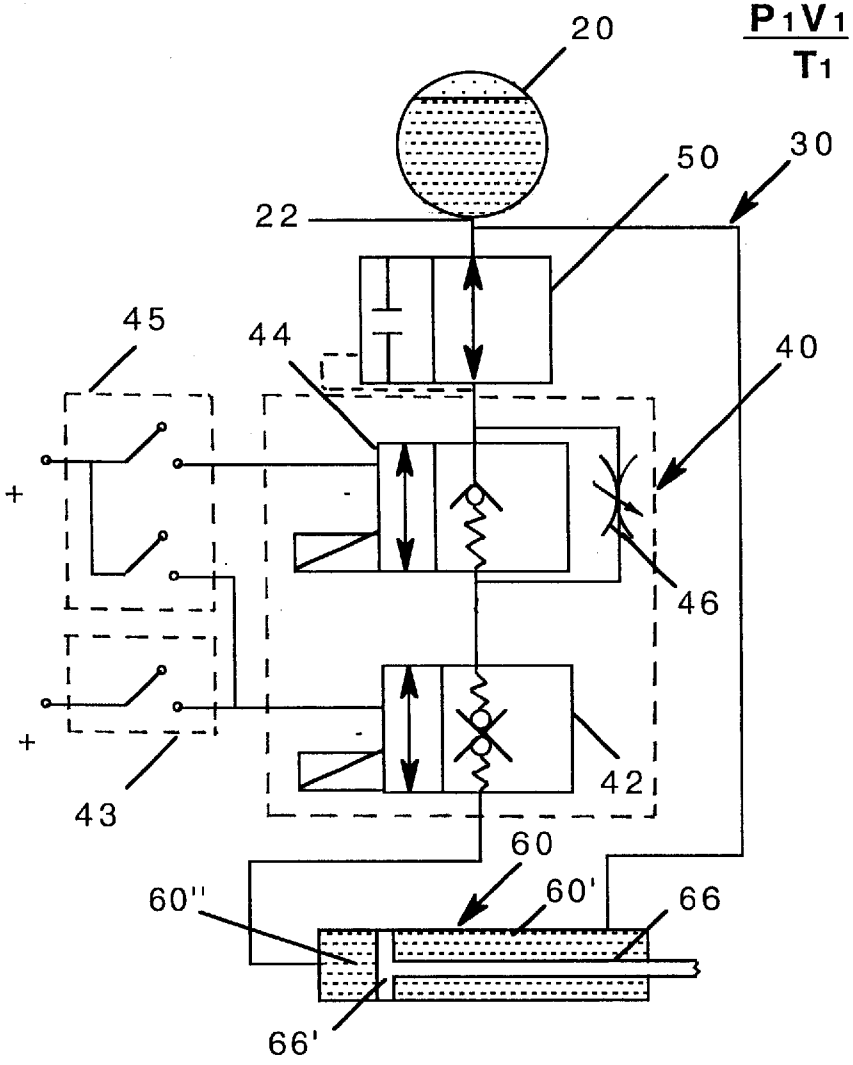

FIG. 3*a* is a representation of the diagram of operation for the present invention when the switches are opened.

FIG. 3*b* is a representation of the diagram of operation for the present invention when the switches are closed and the piston assembly is distended.

V. DETAILED DESCRIPTION OF THE PREFERRED EMBODIMENT

Referring now to the drawings, where the present invention is generally referred to with numeral 10, it can be observed that it basically includes reservoir assembly 20, hydraulic control assembly 40 and hydraulic cylinder assembly 60 incorporated in a lifting apparatus L to aid a user in lifting arm A.

As shown in FIG. 1, in a typical application, a lifting apparatus L has a lowermost position for its arm A and this is found in many boat davits. At the lowermost position, reservoir assembly 20 holds a compressed gas (i.e. air) and a liquid fluid (i.e. oil), as shown in FIG. 1*a*. Control assembly 40 includes the valve 42 which is closed when not energized. Valve 42 can be implemented with models like No. SBV 11-8-C manufactured by Vickers Incorporated, having its place of business at 5445 Corporate Drive, P.O. Box 302, Troy, Mich. 48007-0302 and similar. Valve 42 is opened by closing switch 43. The pressurized gas forces the liquid out of reservoir 20 through outlet 22. From valve 42, the liquid has two possible paths. One by going through valve 44 and the other path by going through variable manual bypass valve 46. Valve 44 is similar to valve 42 and is normally closed and opens in one direction only when energized. This is so that the liquid can flow freely when valve 44 is opened (and valve 42 is also opened) to fill hydraulic cylinder assembly 60. However, when a load is applied, the liquid can not go back except through bypass valve 46 even if valve 44 is activated thus allowing a user to regulate the speed from dropping arm A.

Optionally, a flow fuse valve 50 is used to prevent any accidental sudden flow. Fuse valve 50 limits the maximum flow that can be achieved at any time. Thus the liquid passes through hydraulic control assembly 40 and into one of the chambers of hydraulic cylinder assembly 60 urging piston assembly 66 to move towards the distended position. The force exerted on piston assembly 66 is proportional to the pressure of the pressurized gas and the effective area. Cylinder assembly 60 includes rear and front portions 60' and 60", respectively, divided by piston head 66'. The force should be sufficient to lift arm A of lifting apparatus L, or at least help a user undertake this task. Arms A can be heavy and difficult to lift unaided. Once arm A is lifted, positioned and locked in place, a user operates lifting apparatus L which typically include a spool S or other mechanisms for lifting the weight W.

As seen in FIGS. 1*a*, 2*a*, 3*a*, and 3*b*, hose 30 connects outlet 22 with the rear portion 60' of cylinder assembly 60. Connection hose 30 provides compressed liquid fluid (i.e. oil) to the piston assembly 66 to keep it lubricated. The compressed liquid fluid (i.e. oil) flows freely through connection hose 30 to partially counter-act the pressure applied to front portion 60" of cylinder assembly 60. The force exerted from the rear portion 60' is smaller than the force exerted from front portion 60" because the former has a smaller effective area (total area less the area of the shaft). Therefore, the force will be the product of the same pressure by different effective areas. It has been found that in marine applications it is necessary to maintain both portions lubricated.

After the operation is concluded, arm A is unlocked and lowered, typically a user hangs from the distal end applying his/her weight, and forcing the liquid inside reservoir assembly 20 thereby restoring the gas to its pressurized state.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A self-contained hydraulic system, comprising:

A) a lifting assembly including a pivotally mounted arm;

B) a hydraulic reservoir for a pressurized gas and a liquid, said reservoir further including a first outlet;

C) hydraulic control means for controlling the flow of liquid through said first outlet and further including a first inlet and a second outlet said first inlet connected to said first outlet; and D) a hydraulic cylinder having a front and rear portions and a second inlet at said front portion connected to said second outlet and a piston assembly movable between two extreme positions, said piston assembly including a piston head and a shaft with a distal end pivotally mounted to said arm so that when said valve means is opened said pressurized liquid forces said piston head and shaft to one of said extreme positions in full distension thereof, and upon the application of force in opposite direction, the pressurized liquid is forced back inside said hydraulic reservoir.

2. The system set forth in claim 1, further including fuse valve means connected in series with said hydraulic control means so that the flow of said liquid is restricted to a predetermined maximum rate.

3. The system set forth in claim 2 wherein said hydraulic control means includes a normally closed first valve means having first valve means inlet and outlet said first valve means inlet connected to said first inlet and said first valve means outlet connected to said second outlet, and said first valve means being electrically activated.

4. The system set forth in claim 3 wherein said hydraulic control means includes a normally closed second valve means having a second valve means inlet and outlet, said second valve means inlet being connected to said first valve means outlet and said second valve means outlet being connected to said second outlet of said hydraulic control means, and said second valve means being capable of permitting the flow of said liquid from said first valve means outlet to said second outlet only.

5. The system set forth in claim 4 wherein second valve means includes a variable valve means connected in parallel so that a user can selectively vary the amount of liquid allowed to bypass said second valve means.

6. The system set forth in claim 5 wherein said hydraulic cylinder includes a third inlet at said rear portion and further including:

E) conduit means connecting said first outlet to said third outlet so that said hydraulic liquid fills said rear portion housing said shaft partially offsetting the force applied against said piston head in said front portion of said hydraulic cylinder.

* * * * *